US009487016B2

(12) United States Patent
Murphy et al.

(10) Patent No.: US 9,487,016 B2
(45) Date of Patent: Nov. 8, 2016

(54) FLUID CARTRIDGE SUB-ASSEMBLY

(71) Applicant: Hewlett-Packard Development Company, L.P., Houston, TX (US)

(72) Inventors: Bryan Murphy, Lucan (IE); Jon Rittgers, Celbridge (IE); John McNeilly, Dublin (ES); Odhran Hendley, Bray (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/780,820

(22) PCT Filed: Mar. 28, 2013

(86) PCT No.: PCT/US2013/034344

§ 371 (c)(1),
(2) Date: Sep. 28, 2015

(87) PCT Pub. No.: WO2014/158163

PCT Pub. Date: Oct. 2, 2014

(65) Prior Publication Data

US 2016/0082741 A1 Mar. 24, 2016

(51) Int. Cl.
*B41J 2/175* (2006.01)

(52) U.S. Cl.
CPC ..... *B41J 2/17553* (2013.01); *B41J 2/1752* (2013.01); *B41J 2/17513* (2013.01)

(58) Field of Classification Search
CPC ..... B41J 2/117553; B41J 2/17513; B41J 2/1752
See application file for complete search history.

(56) References Cited

U.S. PATENT DOCUMENTS

| | | | | |
|---|---|---|---|---|
| 6,036,306 | A * | 3/2000 | Haigo | B41J 2/17513 347/86 |
| 6,733,115 | B2 | 5/2004 | Santhanam et al. | |
| 2004/0160480 | A1 | 8/2004 | Kulpa et al. | |
| 2007/0229624 | A1* | 10/2007 | Kawamura | B41J 2/17509 347/86 |
| 2008/0143805 | A1* | 6/2008 | Morgan | B41J 2/17513 347/92 |
| 2008/0239040 | A1 | 10/2008 | Umeda | |
| 2010/0238242 | A1 | 9/2010 | Rittgers et al. | |
| 2011/0050820 | A1* | 3/2011 | Foster | B41J 2/1754 347/86 |
| 2012/0200635 | A1 | 8/2012 | Sugahara | |

FOREIGN PATENT DOCUMENTS

WO WO-2009123636 10/2009

OTHER PUBLICATIONS

PCT Search Report, Dec. 16, 2013, PCT Patent Application No. PCT/US2013/034344, Korean Intellectual Property Office.

* cited by examiner

*Primary Examiner* — Manish S Shah
*Assistant Examiner* — Yaovi M Ameh
(74) *Attorney, Agent, or Firm* — HP Inc. Patent Department

(57) ABSTRACT

A fluid cartridge sub-assembly comprising a first vent bore, an elongate air channel, a cover extending over the first vent bore and the air channel, and a second vent bore connected to the air channel.

20 Claims, 9 Drawing Sheets

FLUID CARTRIDGE SUB-ASSEMBLY

CROSS-REFERENCE TO RELATED APPLICATION

This application is a U.S. National Stage Application of and claims priority to International Patent Application No. PCT/US2013/034344, filed on Mar. 28, 2013, and entitled "FLUID CARTRIDGE SUB-ASSEMBLY," which is hereby incorporated by reference in its entirety.

BACKGROUND

Known types of in-store ink cartridges have a recessed labyrinth in a lid. A sealing label is adhered to the lid over the labyrinth, sealing the labyrinth and forming an air channel. At one end of the labyrinth a vent bore extends through the wall, opening into the inner volume of the cartridge. Before installing the cartridge, part of the labyrinth needs to be exposed to air by detaching a part of the sealing label that covers it. This allows for air to be exchanged between the inner volume and the environment through the labyrinth.

BRIEF DESCRIPTION OF THE DRAWINGS

For the purpose of illustration, certain examples constructed in accordance with this disclosure will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements.

Figure 1:
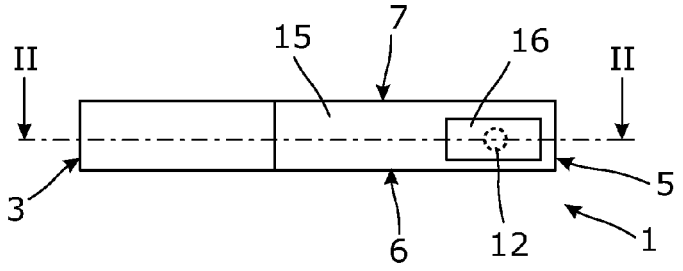
FIG. 1 illustrates a diagrammatic top view of an example of a fluid cartridge.
Figure 2:
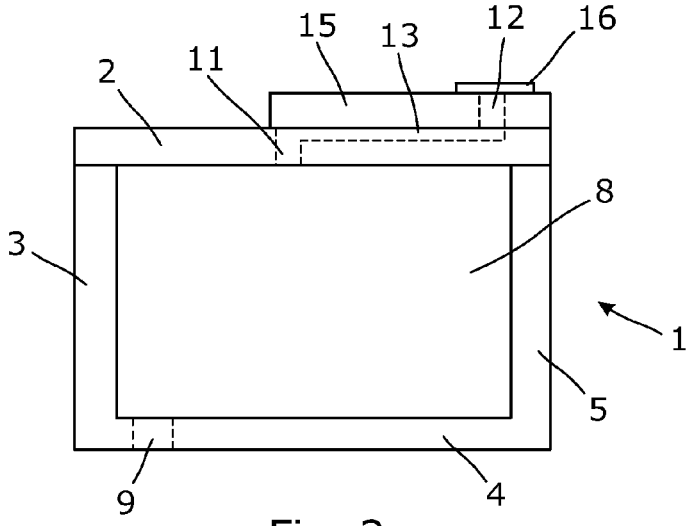
FIG. 2 illustrates a diagrammatic cross-sectional side view of the example fluid cartridge of FIG. 1.
Figure 3:
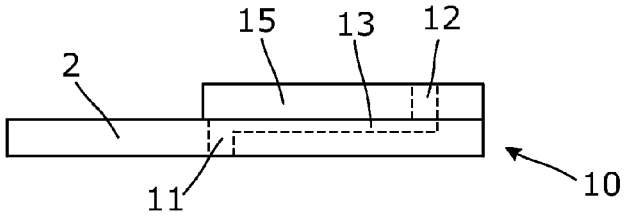
FIG. 3 illustrates a diagrammatic cross-sectional side view of an example of a sub-assembly of the fluid cartridge of FIGS. 1 and 2.

FIG. 1 illustrates a top view of an example of a fluid cartridge 1. FIG. 2 illustrates a cross-sectional side view of the example fluid cartridge 1. FIG. 3 illustrates a sub-assembly 10 of the example fluid cartridge 1 of FIGS. 1 and 2.

Referring to FIGS. 1 and 2, the fluid cartridge 1 includes walls 2, 3, 4, 5, 6, 7 that enclose an inner volume 8. The inner volume 8 includes fluid such as ink. For example, the inner volume 8 includes a capillary medium for holding the ink. In another example the inner volume 8 includes an expandable bag or a sequence of channels and chambers to regulate inner pressure. The illustrated example shows the inner volume 8 as one space. In other examples, the inner volume 8 contains multiple chambers that are fluidically interconnected. In yet another example the inner volume 8 includes multiple separate chambers that are not fluidically connected, for example for holding different inks for example of different colors.

For example, the fluid cartridge 1 includes a fluid supply port 9. For example, the fluid supply port 9 is provided in or near a bottom wall 4. The fluid supply port 9 is to supply fluid to a receiving structure such as a printer. For example the fluid supply port 9 includes a filter or wick for holding and supplying the fluid once brought into contact with the receiving structure. In another example the fluid cartridge 1 includes multiple fluid supply ports 9, for example each connected to a separate chamber of the inner volume 8. In yet another example the fluid cartridge 1 can include an integrated head land with print head for directly ejecting fluid.

The fluid cartridge 1 includes a top wall 2. The fluid cartridge 2 includes a cover 15. For example the cover 15 includes relatively rigid material such as a molded plastic that is thick enough to resist folding. For example the thickness T of the cover 15 is at least approximately 0.2 millimeters or at least approximately 0.4 millimeters, for example in a range of between approximately 0.2 and 1.4 millimeters or approximately 0.6 and 1 millimeters. The cover 15 is attached to the top wall 2, and covers at least a portion of the top wall 2. The fluid cartridge 1 includes a first vent bore 11 that is fluidically connected to the inner volume 8. For example, the first vent bore 11 protrudes through the top wall 2. The fluid cartridge 1 includes a second vent bore 12 that is fluidically connected to the environment. For example, the second vent bore 12 protrudes through the cover 15. An air channel 13 is connected to the first vent bore 11 and the second vent bore 12 so that air can flow between the inner volume 8 and the environment. For example the air channel 13 is arranged to allow air to pass while maintaining humidity within the inner volume 8 at a suitably high level, such as for example close to approximately 100%, at least over a predetermined time period. For example the air channel 13 has an elongate shape that allows air to pass while inhibiting vapor transport. For example the greater the ratio of the length of the channel 13 to the cross sectional area of the channel 13, the greater its effectiveness in minimizing vapor loss. For example the air channel is a labyrinth. For example the air channel 13 has a serpentine shape. For example the air channel 13 is formed in one or both of the top wall 2 and cover 15. For example the air channel 13 is formed by a recess in the top wall 2 and the cover 15 forms a roof of the air channel 13. For example during manufacture the air channel 13 is molded as a thin, elongate labyrinth structure into the top wall and the relatively rigid cover 15 is attached to the top wall 2 so that the second vent bore 12 connects to the air channel 13. In a further example a seal 16 such as a sealing label covers the second vent bore 12. For example the seal 16 is relatively flexible to allow bending and folding. For example the seal is a film having a thickness of approximately 0.2 millimeters or less or approximately 0.1 millimeters or less, or for example 0.5 millimeters or less, for example in the order of 100 or 200 microns. For example, the seal 16 is attached to the cover 15. The seal 16 seals the second vent bore 12, therewith inhibiting air or vapor transport through the air channel 13. For example the seal 16 is to be at least partly detached from the cover 15 to expose the second vent bore 12 to the environment, before installing the cartridge 1 in the receiving structure such as a printer. For example the seal 16 is a label that is to be torn off the cover 15. For example the seal 16 includes fluid or liquid impermeable coating and/or polymers along with adhesives. For example the seal 16 is adhered or welded to the cover 15. For example glue or a weld seam attaches the seal 16 and surrounds the top edge of the second vent bore 12 to inhibit exchange of gas and vapor.

FIG. 3 illustrates an example of a sub-assembly 10 of the fluid cartridge 1. For example the sub-assembly 10 includes the top wall 2. For example the sub-assembly 10 includes the cover 15. For example the sub-assembly 10 includes the first vent bore 11 extending through the top wall 2. For example the sub-assembly 10 includes the second vent bore 12 extending through the cover 15. For example the sub-assembly 10 includes the air channel 13 extending between the first and second vent bore 11, 12. For example the sub-assembly 10 is an intermediate product to be assembled with other parts for forming a complete fluid cartridge 1. For example, in a manufacturing step, the sub-assembly 10 is attached to inner volume forming-walls 3, 4, 5, 6, 7 after placing a capillary medium in the inner volume 8 for closing the inner volume 8. In other examples the sub-assembly 10 includes at least parts of multiple cartridge walls. For example the sub-assembly 10 can be defined as a cartridge lid for closing the inner volume 8.

Figure 4:
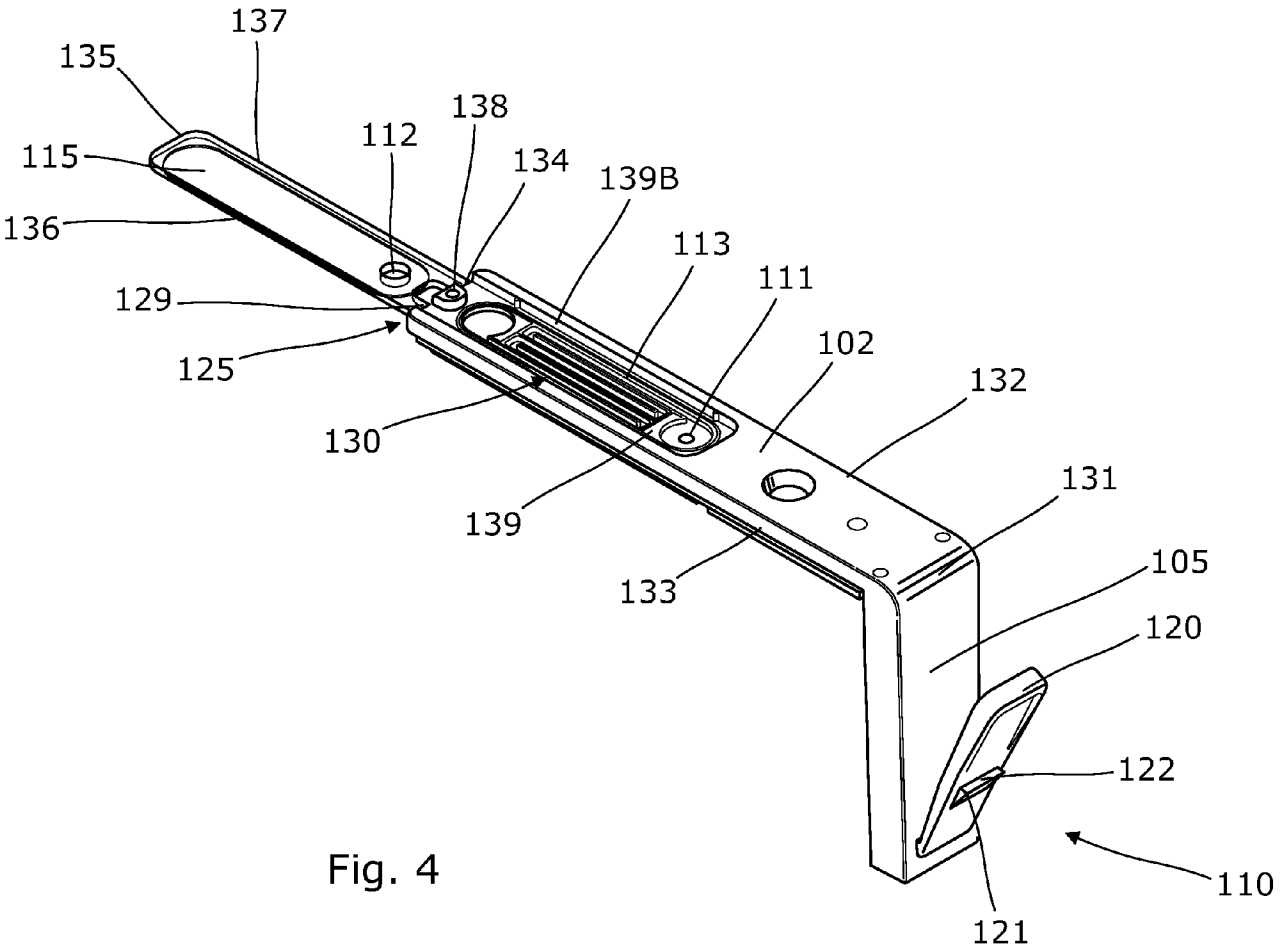
FIG. 4 illustrates a perspective view of another example of a sub-assembly of a fluid cartridge, in a first state.
Figure 5:
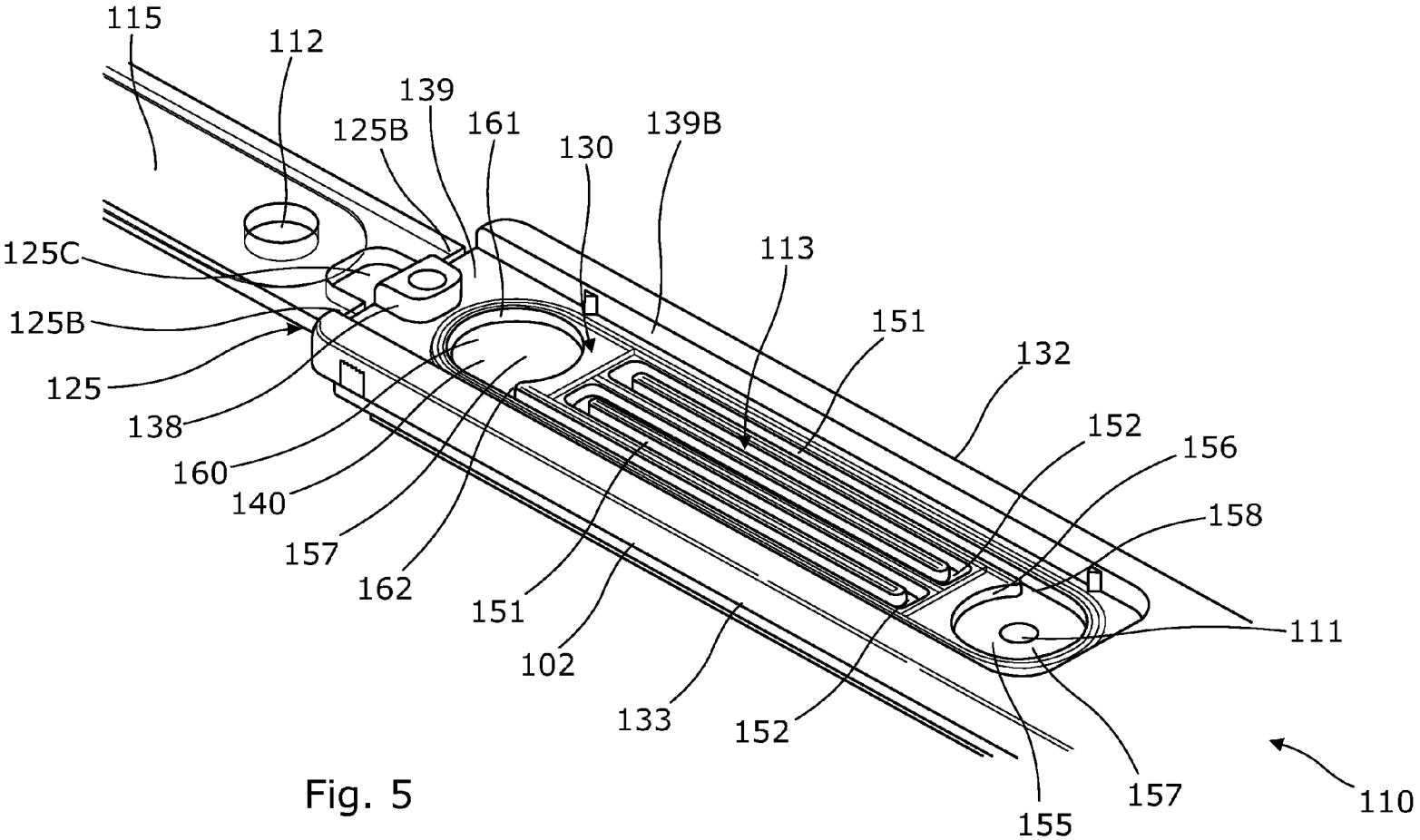
FIG. 5 illustrates a perspective view of a detail of the example sub-assembly of FIG. 4 in the first state.

FIGS. 4 and 5 illustrate another example of a sub-assembly 110 of a fluid cartridge. In FIGS. 4 and 5 the sub-assembly 110 is illustrated in a first state, wherein a cover 115 is opened with respect to a top wall 102. For example in the illustrated first state the sub-assembly 110 is still in the mold. For example a mold cavity has the shape of the sub-assembly 110 in the first state for molding the sub-assembly in the first state in one molding step. For example the sub-assembly 110 is manufactured by injection molding, compression molding, or any suitable type of molding.

Figure 6:
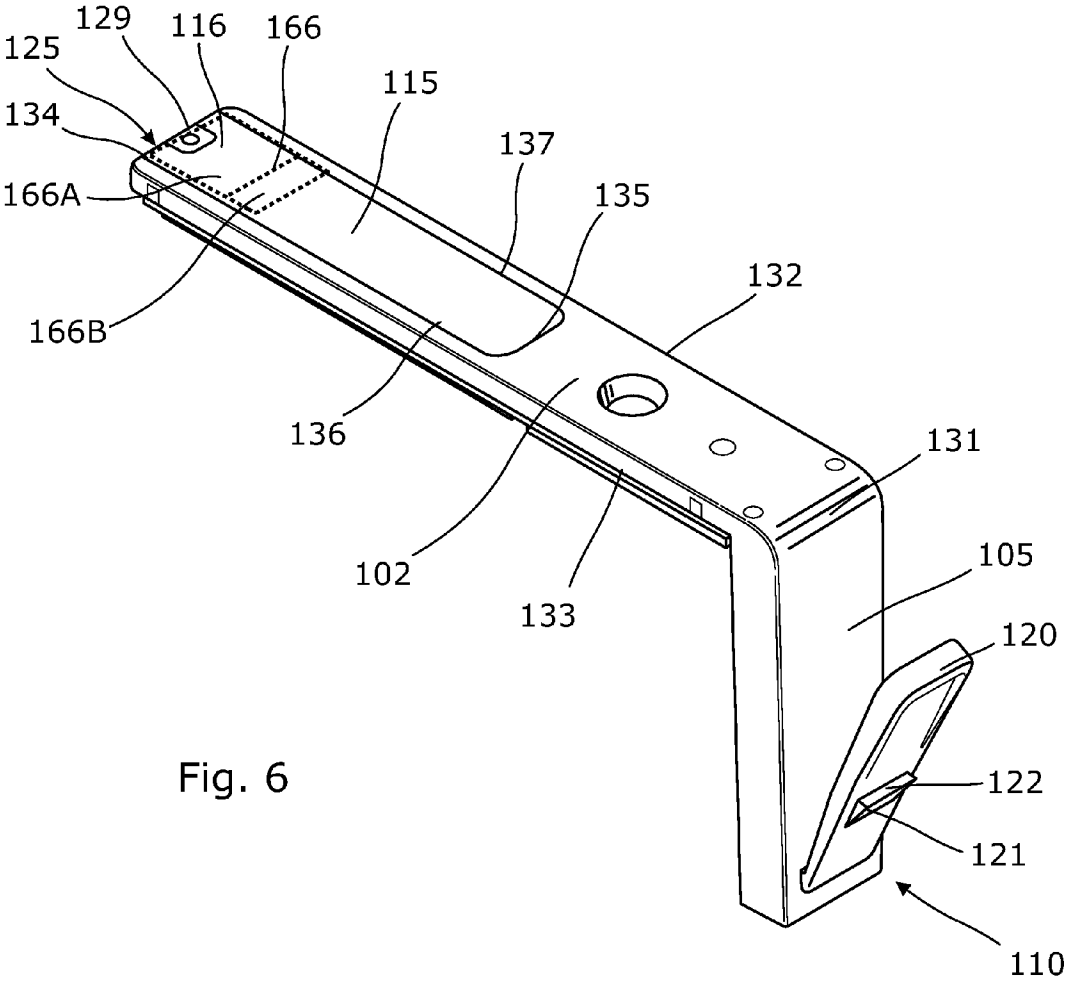
FIG. 6 illustrates a perspective view of the example sub-assembly of FIG. 4 in a second state.

FIG. 6 illustrates the same example sub-assembly 110 as FIGS. 4 and 5 but in a second state, wherein the cover 115 is attached to the top wall 102. For example the sub-assembly 110 will be assembled, sold and used as part of the fluid cartridge in the second state. For example in the second state the cover 115 is pressed into the top wall 102 and/or welded to the top wall 102 during or after ejecting the sub-assembly 110 from the mold. In this disclosure, certain features of the sub-assembly 110 may be best illustrated by the drawings of the sub-assembly 110 in the first state (FIGS. 4 and 5), although these features may reach their end function and/or final shape in the second state (FIG. 6).

As illustrated in FIGS. 4-6, the sub-assembly 110 can include a cartridge top wall 102 and a cartridge back wall 105. For example the sub-assembly 110 functions as a lid for tapping a fluid cartridge after placing a capillary medium in its inner volume. For example the top wall 102 and the back wall 105 together have an L-shape. For example the top wall 102 and back wall 105 are to be adhered or welded to a cartridge bottom wall and side walls to enclose an inner volume. For example the top wall 102 and back wall 105 are integrally molded. For example, the top wall 102 and back wall 105 and cover 115 are integrally molded. For example the whole sub-assembly 110 is defined by one monolithic shape, integrally molded in one molding step. In another example some of the features are welded to form part of the monolithic shape.

For example the back wall 105 includes a latch 120 protruding from the back wall 105. For example the latch 120 is integrally molded with the back wall 105. For example the latch 120 extends from a bottom of the back wall 105 upwards. For example the latch 120 is to hinge with respect to the back wall 105. For example the latch 120 includes a ramp 121 with a stop surface 122 for engaging a corresponding latch feature of a receiving structure, to lock the fluid cartridge in the receiving structure. For example by hinging the latch 120 inwards towards the back wall 105 the cartridge is unlocked and can be taken out of the receiving structure.

The sub-assembly 110 includes a cover 115. The cover 115 is attached to the top wall 102, for example through a live hinge 125. For example the cover 115 and top wall 102 are molded in one step together with the hinge 125, forming said monolithic shape. For example the hinge 125 is to hinge the cover 115 with respect to the top wall 102. For example, in the first state (FIG. 4, 5) and end of the cover 115 is attached to the end of the top wall 102 that is opposite to the back wall 105, through said hinge 125. For example in the second state (FIG. 6) the cover 115 is attached to the top wall 102 over the full length of the cover 115 by hinging the cover 115 about the hinge 125. For example, the live hinge 125 is relatively thin and flexible. For example the live hinge 125 is a film hinge. For example the cover 115 is relatively rigid and thicker than the live hinge 125. For example, the sub-assembly 110 is molded in one piece, forming a relatively rigid plastic construction with the exception of the hinge 125 which is flexible and allows for hinging of the cover 115 with respect to the top wall 102.

For example the hinge 125 includes multiple hinge arms 125B. For example the hinge 125 does not extend along the full width of the edge 134 of the cover 115 to which it is attached. For example there is provided an empty space 125C between the hinge arms 125B, interrupting the hinge 125. For example the hinge 125 includes two parallel live hinge arms 125B with the empty space 125C in between. For example such interrupted hinge 125 would facilitate better welding of the cover 115 to the top wall 102.

For example the top wall 102 has a rectangular, longitudinal shape with short opposite head edges 129, 131 and long opposite side edges 132, 133. For example the cover 115 also has a rectangular, longitudinal shape with short opposite head edges 134, 135 and long opposite side edges 136, 137. For example the cover 115 is shorter than the top wall 102. For example the cover 115 spans approximately half the length of the top wall 102 or less.

The top wall 102 includes a first vent bore 111 that protrudes through the top wall 102. For example the first vent bore 111 is provided near the middle of the top wall 102 and/or near a head edge 135 of the cover 115. For example the cover 115 includes a second vent bore 112. For example, in the second state the second vent bore 112 is provided near the hinging edge 134 of the cover 115, and near a head edge 129 of the top wall 102, opposite to the back wall 105.

The top wall 102 includes a recess 130 for receiving the cover 115 in the second state. For example the recess 130 has first recess walls 139B having a similar shape as the outer edges of the cover 115, to allow the cover 115 to be press fitted in the recess 130. For example the top wall 102 includes a tooling datum 138, for example, protruding outwardly into the first recess 130 and/or outwardly away from the top wall 102. For example the tooling datum 138 is to locate the sub-assembly 110 in a manufacturing tool.

In the second state the cover 115 is pressed against the first recess level 139. For example a second recess 140 is provided within the first recess 130 as a further recess. Hence the top wall 102 includes a multiple level recess 130, 140. The second recess 140 is deeper than the first recess 130. In the illustrated example the second recess 140 includes an air channel 113 and a first and second chamber 155, 156. For example in the second state the cover 115 is fitted in the first recess 130 and covers the second recess 140. For example the cover 115 is press fitted in the first recess 130 and presses against the first recess level 139, fluid tightly sealing the second recess 140.

For example the cover 115 is welded to the top wall 102. For example the cover 115 is welded to the first recess level 139 and/or to the first recess walls 139B. For example the cover 115 is welded to provide a fluid tight weld seam 113 (FIG. 6) between the cover 115 and the top wall 102, the seam 113 surrounding the second recess 140 to prevent that fluid may escape. For example the cover 115 is welded to the top wall 102 during a welding of the sub-assembly 110 to the fluid cartridge or in a separate process. For example the cover 115 is ultrasonically welded to the top wall 102.

For example the second recess 140 includes an air channel 113. In the second state, the air channel 113 fluidically connects the first vent bore 111 and the second vent bore 112. For example the air channel 113 has a relatively thin and elongate shape to prevent too much vapor loss. For example a cross-sectional width W or diameter of the air channel 113 is in the order of approximately one millimeter or less or two millimeters or less. For example a cross sectional area of the air channel 113 is approximately 0.35 square millimeters, or for example between approximately 0.1 and 1 square millimeters. For example a length of the air channel 113, for example as measured between the air channel gates 158, 162, is approximately 110 millimeters, or for example between approximately 20 and 300 millimeters. For example the air channel 113 has a serpentine, zigzag or curved shape, therewith giving the air channel a desired length within the available top wall surface. In the illustrated example, the air channel 113 has a serpentine shape. For example the air channel 113 has longer straight portions 151 and shorter turn portions 152 wherein the straight portions 151 extend parallel to the side edges 132, 133 of the top wall 102, and the turn portions 152 connect the straight portions 151. For example the turn portions 152 turn the air channel 113 over approximately 180 degrees. For example the straight portions 151 have a straight shape parallel to the side edges 132, 133 of the top wall 102. In the illustrated example, the air channel 113 has four turn portions 152 in two opposite pairs. In other examples the air channel 113 has at least two turn portions 152, or for example at least four or at least six turn portions 152. For example by having relatively long straight air channel portions 151, parallel to the side edges 132, 133, and consequently, a relatively low number of turn portions 152 a weld connection of the cover 115 is relatively robust. Then again, different serpentine or zigzag air channel shapes may be suitable. In another example (not illustrated) the straight portions 151 extend perpendicular to the top wall side edges 132, 133, or at another angle such as approximately 45 degrees.

For example the second recess 140 includes a first chamber 155 between a first end of the elongate air channel 113 and the first vent bore 111 (FIG. 5). For example the first chamber 155 extends around the first vent bore 111. For example the first vent bore 111 opens into the first chamber 155 for example approximately in the middle of the first chamber 155. For example the first chamber 155 is formed by a circular wall 156 around and at a distance from the first vent bore 111, and by a bottom 157 of the second recess 140, while the cover 115 defines a roof. An air channel gate 158 is provided in the circular wall 156 that defines the first end of the air channel 113.

Similar to the first chamber 155 a second chamber 160 extends between a second end of the elongate air channel 113 and the second vent bore 112. For example in the second state the second chamber 160 extends around the second vent bore 112. For example the second vent bore 112 opens into the second chamber 160 for example approximately in the middle of the second chamber 160. For example the second chamber 160 is formed by a circular wall 161 around and at a distance from the second vent bore 112, and by a bottom 157 of the second recess 140, while the cover 115 defines a roof. An air channel gate 162 is provided in the circular wall 161 that defines the second end of the air channel 113.

Figure 7:
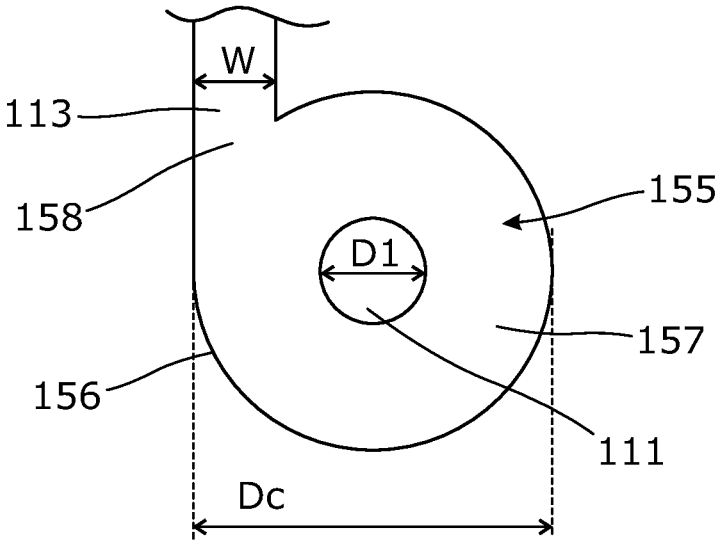
FIG. 7 illustrates a top view of an example of a chamber, vent bore, and air channel.

For example, as illustrated in FIG. 7, a diameter Dc of the first chamber 155 is larger than a diameter D1 of the first vent bore 111 and larger than a cross-sectional width W of the air channel 113. For example, in a similar manner, a diameter of the second chamber 160 is larger than a diameter of the second vent bore 112 and larger than a cross-sectional width W of the air channel 113. For example the first and/or second chamber 155, 160 widen the air channel 113 near the respective end so that when liquid enters through a respective vent bore 111, 112 the liquid does not block or clog the thin air channel 113.

For example, the sub-assembly 110 includes a seal 116 (FIG. 6). For example the seal 116 covers and seals the second vent bore 112. For example, the seal 116 is at least partly adhered to the cover 115 and/or the top wall 102. For example before installing the fluid cartridge in the receiving structure, the seal 116 is to be at least partly detached to expose the second vent bore 112. For example the seal 116 includes a label or film. For example the seal 116 includes a tear-line 166 located next to the second vent bore 112 at the side of the first vent bore 11 for parting the seal 116 over said line. For example the tear-line 166 parts the seal 116 in two parts 166A, 166B. For example the tear-line 166 is defined by a thin section of the seal 116 and/or by interrupted cut outs in the seal 116. For example by tearing the seal 116 over the tear-line 166 a first part 166A is detached to uncover the second vent bore 112, and a second part 166B remains adhered to the sub-assembly 110. For example the second part 166B contains information such as color or cartridge type information. For example before tearing a portion of the first part 166A is not adhered to the top wall 102 to be able to grab and tear the seal 116. For example the seal 116 is relatively flexible and includes coated paper or plastics having zero or low fluid permeability.

Figure 8:
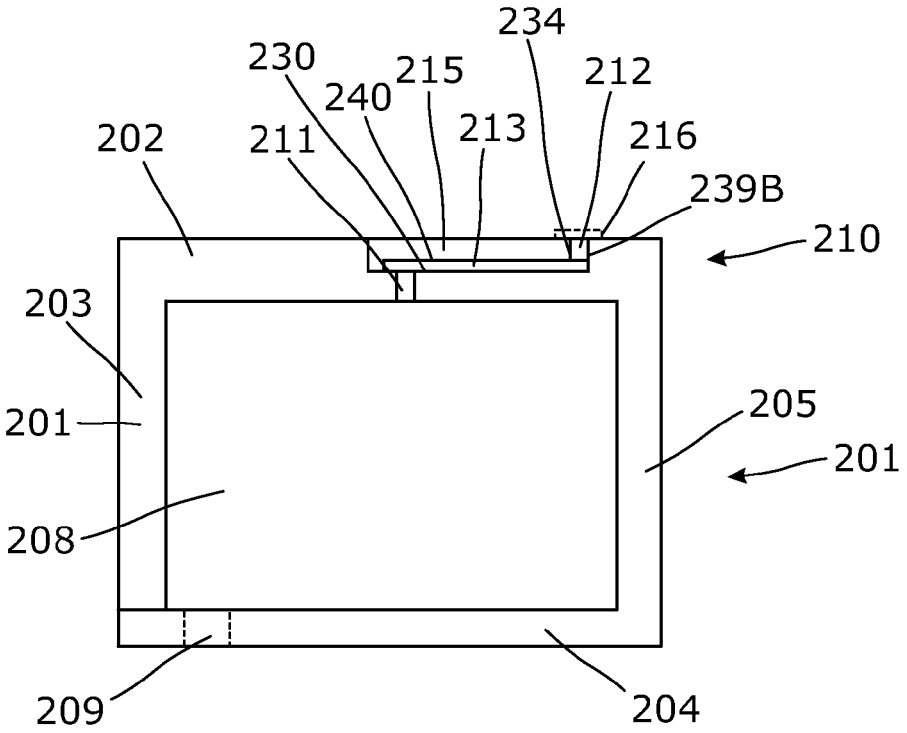
FIG. 8 illustrates a diagrammatic cross-sectional side view of yet another example of a fluid cartridge.
Figure 9:
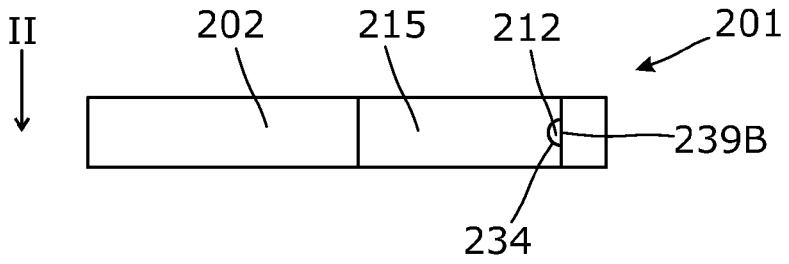
FIG. 9 illustrates a diagrammatic cross-sectional top view of the example fluid cartridge of FIG. 8.

FIGS. 8 and 9 illustrate another example of a fluid cartridge 201, in a diagrammatic cross sectional side view and top view, respectively. The fluid cartridge 201 includes an inner volume 208 containing fluid such as ink. The fluid cartridge 201 includes walls 202, 203, 204, 205 that enclose the inner volume 208. The fluid cartridge includes a fluid supply port 209 for supplying the fluid out of the inner volume 208 to a receiving structure such as a printer. For example, the fluid cartridge 201 includes a sub-assembly 210 that includes at least one wall, for example a top wall 202 and a front wall 203. For example, the top wall 202 includes a first recess 230. For example the top wall 202 includes a first vent bore 211 protruding through the top wall 202 that opens into the inner volume 208 on one end and into the first recess 230 on the other end. For example a second vent bore 212 is provided between the cover 215 and the top wall 102, formed by a side wall 239B of the first recess 230 and the cover head edge 234. The second vent bore 212 is connected to an air channel 213 which is connected to the first vent bore 211.

For example the cover 215 is fitted in the first recess 230. For example the cover 215 includes a second recess 240. For example the second recess 240 is defined by a cut out in the bottom of the cover 215. For example the second recess 240 includes the air channel 213 that fluidically connects the first and second vent bore 211, 212. Like previous examples the second recess 240 may include at least one chamber between one of the vent bores 211, 212 and the air channel 213. For example the air channel 213 is serpentine shaped. For example the fluid cartridge 201 includes a seal 216. The seal 216 is indicated in interrupted lines in FIG. 8 and not indicated in FIG. 9 for reasons of illustration. At point of sale of the cartridge 201 the seal 216 seals the second vent bore 212. The seal 216 is to be at least partially detached from the top wall 202 and cover 215 for exposing the second vent bore 212.

Figure 10:
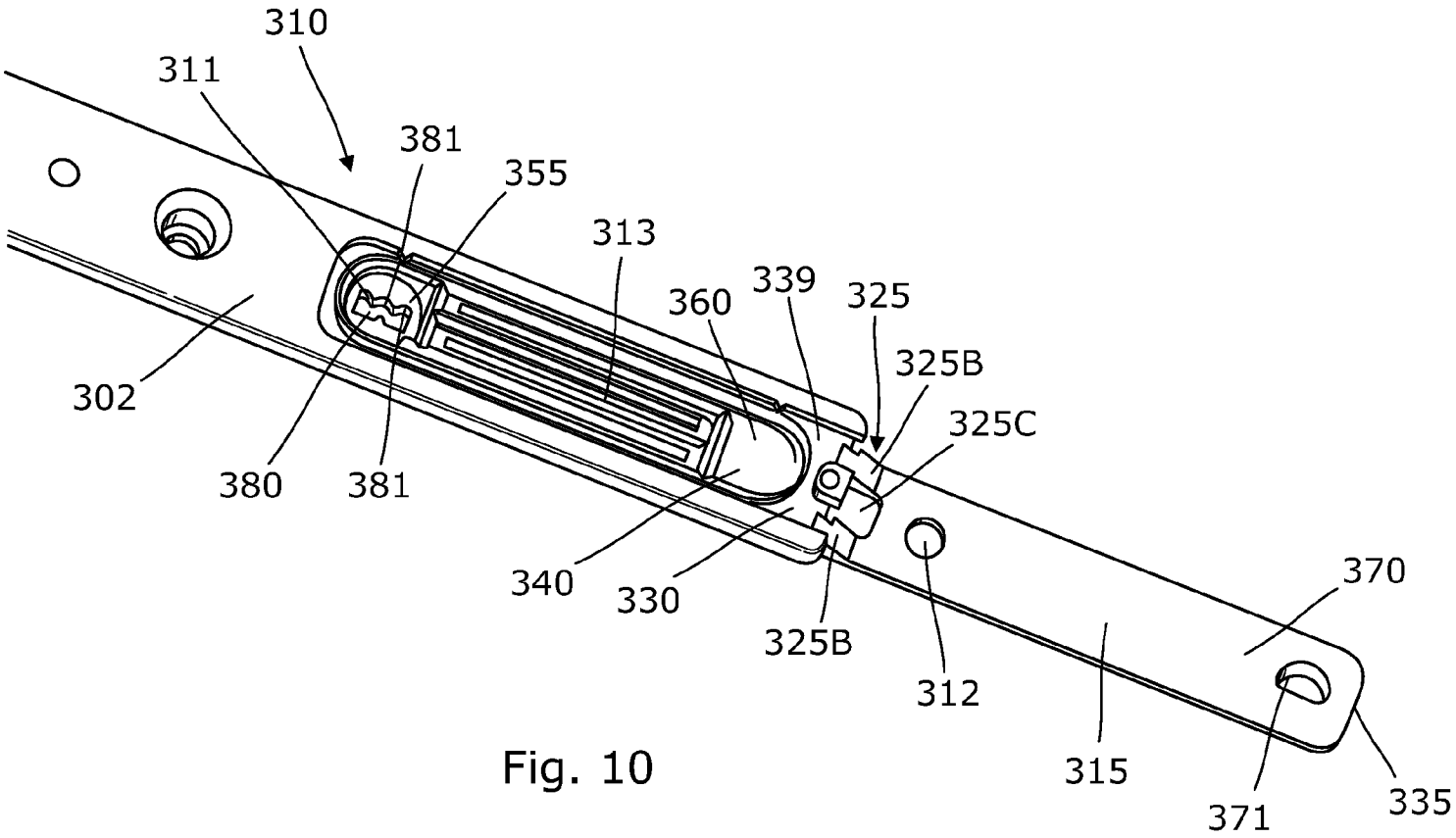
FIG. 10 illustrates a perspective view of yet another example of a part of a sub-assembly of a fluid cartridge in a first state.
Figure 11:
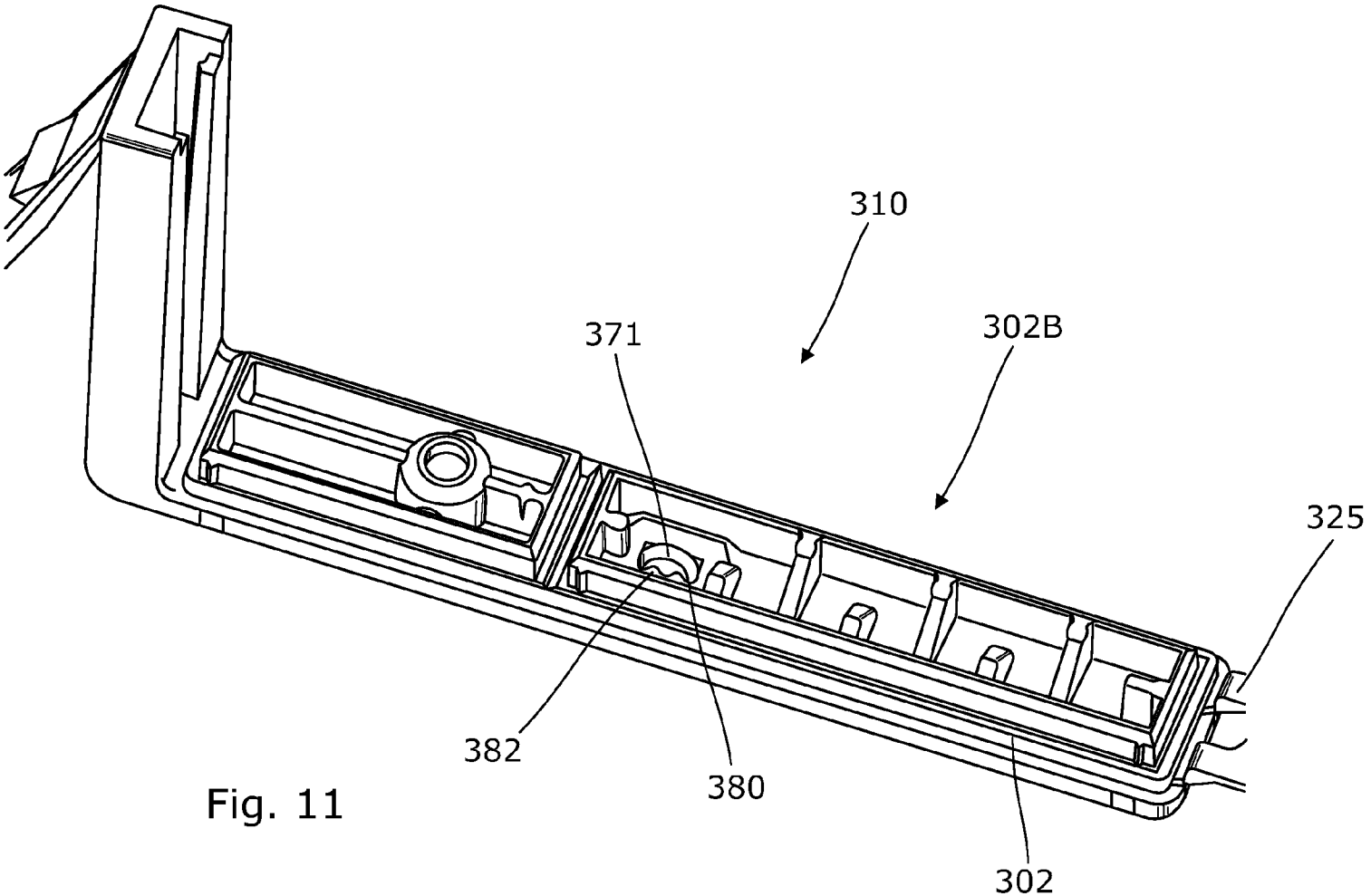
FIG. 11 illustrates a perspective view of the example sub-assembly of FIG. 10 in a second state.
Figure 12:
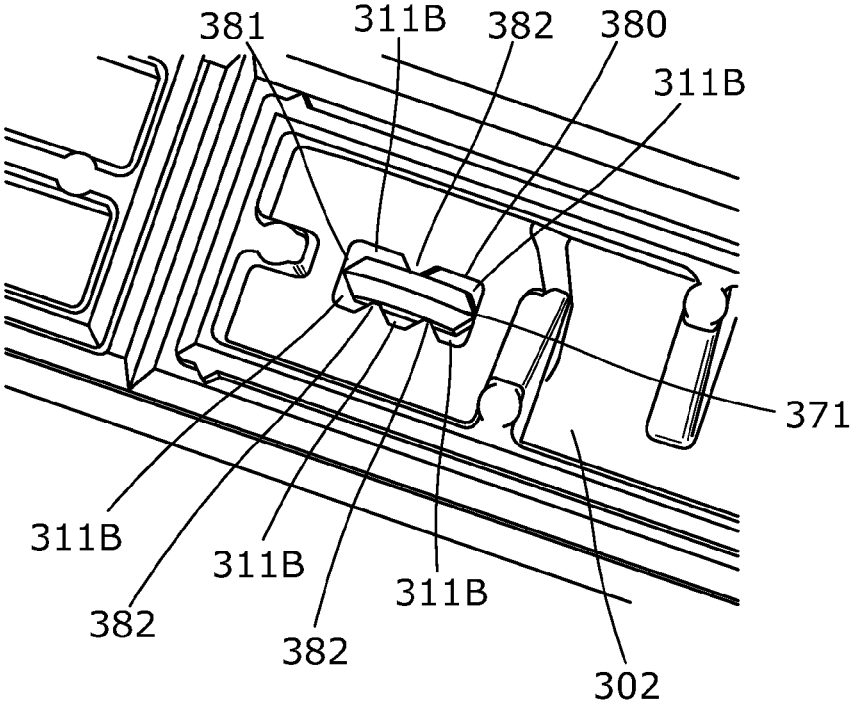
FIG. 12 illustrates a perspective view of a detail of the example sub-assembly of FIGS. 10 and 11 in the second state.

FIGS. 10-12 illustrate yet another example of a sub-assembly 310 of a fluid cartridge. FIG. 10 illustrates the sub-assembly 310 in a first state wherein the cover 315 is opened with respect to the top wall 302 and FIGS. 11 and 12 illustrate the sub-assembly 310 in a second state wherein the cover 315 is closed with respect to the top wall 302. For illustrative purposes FIGS. 11 and 12 of the second state illustrate a view on a bottom side of the top wall 302. Similar to previous examples, the sub-assembly 310 includes a top wall 302 for a fluid cartridge, and a cover 315 that is hingeably connected to the top wall 302 through a live hinge 125. The live hinge 125 includes two hinge arms 125B and an empty hingeless space 125C in between the hinge arms 125B. Similar to previous examples, the top wall 302 includes a first recess 330 for receiving the cover 315 and a second recess 340, within the first recess 330, forming an air channel 313 and air chambers 355, 360 as part of the vent device. The cover 315 includes a second vent bore 312 for fluidic connection to the air channel 313 in the second state.

For example, the cover 315 and the top wall 302 include a tongue 371 and a corresponding receiving slot 380. For example the receiving slot 380 is to receive the tongue 371 when the cover 315 is hinged into the first recess 330. For example the receiving slot 380 is to clamp the tongue 371 to retain the cover 315 in the second state, for example to maintain the cover 315 in position during and after welding. In the illustrated example the tongue 371 is part of and protrudes from the cover 315. The receiving slot 380 is included in the top wall 302. In another example (not shown) the top wall 302 includes a protruding tongue 371 and the cover 315 includes the receiving slot 380 for receiving the tongue 371.

For example the cover 315 includes an engaging face 370 that will engage a first recess level 339 in the second state. For example, the tongue 371 protrudes from the engaging face 371 to be inserted in the receiving slot 380. For example the tongue 371 is located near a head edge 335 of the cover 315, opposite to the hinge 325. In the drawings the tongue 371 has a rounded tongue shape but in other examples the tongue 371 may have any suitable shape for insertion in a corresponding slot.

For example the tongue 371 is located at the site of the first vent bore 311, in the second state. For example the first vent bore 311 is formed by the receiving slot 380 and the tongue 371 in the second state (FIGS. 11 and 12). For example in the second state the tongue 371 protrudes through the receiving slot 380 while only partly filling the receiving slot 380. For example vent conducts 311B are formed around the tongue 371, together forming a vent bore 311.

For example the receiving slot 380 is formed by a slot wall 381. For example, the receiving slot wall 381 includes at least one tongue engagement feature 382 to engage the tongue 371 in the second state. For example the tongue engagement features 382 clamp the tongue 371 when it is inserted in the receiving slot 380. For example the tongue engagement features 382 protrude into the receiving slot. For example the tongue engagement features 382 are crush features to be crushed or deformed when the tongue 371 is inserted into the receiving slot 381. For example the vent conducts 311B are formed between the tongue engagement features 382.

In an example, this disclosure includes a fluid cartridge 1, 201 that includes a fluid supply port 9, 209 for supplying fluid to a receiving structure. For example the fluid is ink and the receiving structure is an inkjet printer. In other examples the fluid is a pharmaceutical liquid or a substance for forming a pharmaceutical liquid or any other type of liquid. For example the fluid cartridge 1, 201 includes a lid, wherein the lid is a sub-assembly 10, 110, 210 as described in this disclosure. For example such lid includes a first vent bore 11, 111, 211 directly communicating with an inner volume 8, 208. For example the lid includes an elongate air channel 13, 113, 213 connected to the first vent bore 11, 111, 211. For example, the lid includes a second vent bore 12, 212, 212 connected to the air channel 13, 113, 213, wherein the second vent bore 12, 212 is to directly communicate with ambient air when the seal 16, 116, 216 is at least partly detached. For example, the lid includes a cover 15, 115, 215 extending over the first vent bore 11, 111, 211 and the elongate air channel 13, 113, 213. For example the lid includes a seal 16, 116, 216 attached to the cover 15, 115, 215 sealing the second vent bore 12, 112, 212.

In examples of this disclosure, the seal 16, 116, 216 can be detached to uncover the second vent bore 212, without affecting the air channel 13, 113, 213. For example the seal 16, 116, 216 can be readily staked, welded or adhered to the sub-assembly 10, 110, 210 near the second vent bore 12, 112, 212 to seal the second vent bore 12, 112, 212 before usage. Consequently only a relatively small seal stake area is required to be fluid or liquid tight, hence providing for a relatively low cost and low complexity of the process for sealing the air channel 13, 113, 213. For example the seal 16, 116, 216 can be made of relatively cheap material. In yet another example the small stake area allows for a relatively controlled detachment of the seal 16, 116, 216 by a user, to vent the second vent bore 12, 112, 212. In further examples of this disclosure the separate cover 15, 115, 215 on the top wall 2, 102, 202 provides a relative design freedom of shapes of vent features such as bores 11, 12, 111, 112, 211, 212, chambers 155, 160, and air channels 13, 113, 213. In further examples of this disclosure, the chambers 155, 160 decrease a risk of clogging the air channel 113.

In the explained examples, some of the features are provided in or connected to an example top wall 2, 102, 202, 302. In other examples (not illustrated) these feature can be provided in another wall that is not a top wall 2, 102, 202, 302. For example the sub-assembly 10, 110, 220, 320 includes a side wall, front wall, back wall or bottom wall of a fluid cartridge 1, 201 and features such as but not limited to the bores 11, 111, 211, 311, 12, 112, 212, 312, the air channel 13, 113, 213, 313 and the cover 15, 115, 215, 315 are provided in or attached to the respective side, front, back or bottom wall.

The above description is not intended to be exhaustive or to limit this disclosure to the examples disclosed. Other variations to the disclosed examples can be understood and effected by those of ordinary skill in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Features can be exchanged between the different examples that are illustrated and/or discussed. Multiple alternatives, equivalents, variations and combinations may be made without departing from the scope of this disclosure.

What is claimed is:

1. A fluid cartridge sub-assembly, comprising:
a top wall;
a back wall;
a first vent bore through the top wall;
a relatively rigid cover extending over the first vent bore and integrally molded with the top wall and the back wall in one molding step together with a hinge between the top wall and the cover;
a second vent bore through the cover; and
an elongate air channel molded into the top wall connecting the first and second vent bore wherein the elongate air channel has a shape that allows air to pass while inhibiting vapor transport and wherein the cover forms a roof of the elongate air channel.

2. The sub-assembly of claim 1, comprising a relatively flexible at least partly detachable seal extending over at least a part of the cover for sealing the second vent bore.

3. The sub-assembly of claim 2, the seal comprising a label having a tear-line located next to the second vent bore for parting the label over said line for exposing the second vent bore.

4. The sub-assembly of claim 1, the top wall having relatively short head edges and relatively long side edges, the elongate air channel having a serpentine shape consisting of relatively long straight portions and relatively short turn portions wherein the straight portions extend parallel to the side edges.

5. The sub-assembly of claim 1, the cover and top wall comprising a tongue and a corresponding receiving slot for interconnecting the cover and the top wall.

6. The sub-assembly of claim 5, the tongue protruding from the cover through the receiving slot, so that not-closed-off receiving slot portions around the tongue form the first vent bore.

7. The sub-assembly of claim 1, the top wall comprising a first recess and a second recess within the first recess forming the elongate air channel, the cover extending in the first recess and over the second recess.

8. The sub-assembly of claim 7, the second recess further forming at least one chamber between an end of the air channel and one of the vent bores, the chamber having a wider diameter than the respective vent bore and air channel, as seen perpendicular to the top wall.

9. The sub-assembly of claim 1, comprising a fluid tight weld seam attaching the cover to the top wall.

10. The sub-assembly of claim 1, wherein the hinge is a live hinge connecting the top wall and cover to hinge the cover with respect to the top wall.

11. The sub-assembly of claim 10, comprising two live hinge arms with a hingeless space in between.

12. The sub-assembly of claim 1, being one monolithic shape further comprising a latch protruding from the back wall including a ramp with a stop surface for engaging a corresponding latch feature of a receiving structure.

13. A fluid cartridge, comprising:
an inner volume surrounded by walls including a top wall and a back wall integrally molded in one molding step together with a hinge between the top wall and a cover;
a fluid supply port for supplying fluid out of the inner volume to a receiving structure;
a first vent bore through the top wall directly communicating with the inner volume;
an elongate air channel connected to the first vent bore integrally molded into the top wall;
a second vent bore through the cover and connected to the air channel, to directly communicate with ambient air;
the cover forming a roof over the first vent bore and the elongate air channel, wherein the elongate air channel has a shape that allows air to pass while inhibiting vapor transport; and
a seal attached to the cover sealing the second vent bore.

14. The fluid cartridge of claim 13, comprising a recess in the top wall, the cover being fitted in the recess, the recess including:
a serpentine air channel under the cover; and
a first chamber around the first vent bore; under the cover.

15. The fluid cartridge of claim 13, comprising a live hinge for hinging the cover with respect to the top wall, the cover being attached to the top wall in a fluid tight manner.

16. A fluid cartridge sub-assembly, comprising:
a wall;
a first vent bore through the wall;
a relatively rigid cover extending over the first vent bore, the cover and wall comprising a tongue protruding from the cover and through a corresponding receiving slot for interconnecting the cover and the wall, so that not-closed-off receiving slot portions around the tongue form the first vent bore;
a second vent bore through the cover; and
an elongate air channel connecting the first and second vent bore.

17. The fluid cartridge sub-assembly of claim 16, wherein the cover is integrally molded with the wall including a hinge between the top wall and the cover.

18. The fluid cartridge sub-assembly of claim 17 wherein the wall is a first wall and further comprising a second wall integrally molded with the first wall, the cover and the hinge in one molding step and wherein the elongate air channel is molded into the first wall.

19. The fluid cartridge sub-assembly of claim 18 wherein the second wall further comprises a latch protruding from the second wall and including a ramp with a stop surface for engaging a corresponding latch feature of a receiving structure.

20. The fluid cartridge sub-assembly of claim 16 wherein the elongate air channel has a shape that allows air to pass while inhibiting vapor transport and wherein the cover forms a roof of the elongate air channel.

* * * * *